US007993030B2

(12) United States Patent
Galke et al.

(10) Patent No.: US 7,993,030 B2
(45) Date of Patent: Aug. 9, 2011

(54) LIGHTING SYSTEM

(75) Inventors: Detlef Andreas Galke, North Salt Lake, UT (US); Melvin Hess Pedersen, North Salt Lake, UT (US); Glenda Pedersen, legal representative, North Salt Lake, UT (US)

(73) Assignee: Innovative D-Lites LLC, North Salt Lake, UT (US)

( * ) Notice: Subject to any disclaimer, the term of this patent is extended or adjusted under 35 U.S.C. 154(b) by 205 days.

(21) Appl. No.: 12/366,806

(22) Filed: Feb. 6, 2009

(65) Prior Publication Data

US 2009/0201681 A1 Aug. 13, 2009

Related U.S. Application Data

(63) Continuation-in-part of application No. 11/854,323, filed on Sep. 12, 2007, now Pat. No. 7,591,566.

(60) Provisional application No. 60/844,986, filed on Sep. 15, 2006.

(51) Int. Cl.
*F21V 19/02* (2006.01)

(52) U.S. Cl. ..... 362/285; 362/271; 362/272; 362/286; 362/289; 362/220; 362/371; 362/295; 362/248

(58) Field of Classification Search ..... 362/285, 362/271, 272, 286, 289, 220, 371, 295, 248
See application file for complete search history.

(56) References Cited

U.S. PATENT DOCUMENTS 3,287,552 A 11/1966 Drandell
3,569,691 A * 3/1971 Tracy ..... 362/233
3,692,993 A 9/1972 Robinson
3,702,928 A 11/1972 Alger
4,180,850 A 12/1979 Bivens
4,204,274 A 5/1980 Luderitz
4,454,569 A * 6/1984 Maguire ..... 362/127
4,802,065 A * 1/1989 Minter et al. ..... 362/20
4,967,324 A 10/1990 Barclay
5,025,349 A 6/1991 Gow
5,311,414 A 5/1994 Branham, Sr.
5,404,279 A 4/1995 Wood
5,510,966 A 4/1996 Konecny
5,564,815 A 10/1996 Littman et al.
5,594,628 A 1/1997 Reuter et al.
5,601,361 A * 2/1997 Lawrence ..... 362/238
5,609,408 A 3/1997 Targetti
5,816,687 A 10/1998 Tapp
5,851,061 A * 12/1998 Hegarty ..... 362/20
6,056,419 A * 5/2000 March ..... 362/249.08
6,088,967 A 7/2000 Johnson
6,224,232 B1 5/2001 Rodriguez
6,309,086 B1 10/2001 Tomlinson
6,424,096 B1 7/2002 Lowe et al.
(Continued)

*Primary Examiner* — Anabel M Ton
*Assistant Examiner* — Danielle Allen
(74) *Attorney, Agent, or Firm* — Thorpe North & Western LLP

(57) ABSTRACT

A lighting system comprises a housing suitable for mounting to a structural unit. The housing includes a plurality of enclosure panels. At least two light-bearing members are moveable relative to the housing and are pivotally coupled one to another. A pair of actuators are moveable in opposing directions, one of the light-bearing members being coupled to one of the actuators and an other of the light-bearing members being coupled to an other of the actuators. Movement of the actuators relative to one another results in pivotal movement of the light-bearing members relative to one another, causing an end of each light-bearing member to move further from or closer to the housing.

19 Claims, 13 Drawing Sheets

U.S. PATENT DOCUMENTS 6,517,216 B1 * 2/2003 Cercone et al. ..... 362/220
6,652,121 B1 11/2003 Kneeshaw
6,846,092 B2 * 1/2005 Taylor et al. ..... 362/235
6,918,680 B2 7/2005 Seeberger

* cited by examiner

LIGHTING SYSTEM

RELATED APPLICATIONS

This application is a continuation-in-part of U.S. patent application Ser. No. 11/854,323, filed Sep. 12, 2007, now issued as U.S. Pat. No. 7,591,566, which claims priority to U.S. Provisional Patent Application Ser. No. 60/844,986, filed Sep. 15, 2006, each of which is hereby incorporated herein by reference in its entirety.

BACKGROUND OF THE INVENTION

1. Field of the Invention

The present invention relates generally to informational, decorative or auxiliary lighting systems. More particularly, the present invention relates to lighting systems that can at least partially be concealed or protected within a housing when not in use.

2. Related Art

Decorative and informational lighting displays have been provided in a variety of configurations for many years. One popular type of such displays is the perennial Christmas light display presented by many homeowners in connection with the Christmas holidays (such displays have also become popular with Halloween, Independence Day and a variety of other holidays). Such lighting displays typically include a plurality of "strings" of lights, often connected end-to-end, that are attached to a house near edges of the roof of the house, along raingutters of the house, beneath eaves of the house, etc.

As these lighting displays are rarely a permanent portion of the house, they are often installed a few days or weeks prior to a holiday, and removed after the holiday has passed. Due to the typical location of such displays, installing and removing the light strings often involves the use of ladders, or climbing on or across rooftops, or similar procedures that often place the installer at considerable risk of injury. In the case where the holiday occurs in a season that typically involves cold weather, this risk can be greatly increased due to the presence of ice or snow on the rooftop or on the ground. Also, most such lighting systems are not designed for permanent installation and so must be installed and removed each season. Even in the case where the lighting strings are designed to withstand year-round installation, many homeowners do not wish to leave the strings in place year-round, due to cosmetic reasons.

In addition to these considerations, strings of lights are notoriously difficult to store (and retrieve from storage) without causing the strings to be become frustratingly entangled. Also, extension cords are very often necessary to power the strings of light, adding complexity and fire/electrocution risk to the installation and removal process. Furthermore, the choice of decorative displays that can be presented with such lights is limited by the strands to very plain, one-dimensional displays.

SUMMARY OF THE INVENTION

In accordance with one aspect of the invention, a lighting system is provided, including a housing, suitable for mounting to a structural unit. The housing can include a plurality of enclosure panels, and at least two light-bearing members can be moveable relative to the housing and pivotally coupled one to another. A pair of actuators can be moveable in opposing directions, with one of the light-bearing members being coupled to one of the actuators and an other of the light-bearing members being coupled to an other of the actuators.

Movement of the actuators relative to one another can result in pivotal movement of the light-bearing members relative to one another, causing an end of each light-bearing member to move further from or closer to the housing.

In accordance with another aspect of the invention, a lighting system is provided, including a housing, suitable for mounting to a structural unit, the housing including a plurality of enclosure panels. At least two linear actuators can be moveable relative to one another. At least two light-bearing members can be retractable into and extendable from the housing. A pair of cams can also be provided, each cam being couplable to one of the actuators and to one of the light-bearing members. Each cam can have a plurality of connection points associated therewith, with one of: a linear actuator and a light-bearing member, being removably coupled at the connection points. Movement of the actuators relative to one another results in movement of the cams and movement of the light-bearing members, causing the light-bearing members to be extended from or retracted into the housing.

There has thus been outlined, rather broadly, relatively important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

DETAILED DESCRIPTION

Figure 2:
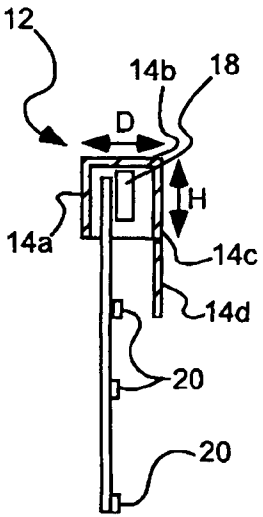
FIG. 2 is an end view of the system of FIG. 1.

Before the present invention is disclosed and described, it should be understood that this invention is not limited to the particular structures, process steps, or materials disclosed herein, but is extended to equivalents thereof as would be recognized by those of ordinarily skill in the relevant arts. It should also be understood that terminology employed herein is used for the purpose of describing particular embodiments only and is not intended to be limiting in any way.

It must be noted that, as used in this specification and the appended claims, the singular forms "a" and "the" include plural referents, unless the context clearly dictates otherwise. Thus, for example, reference to an "enclosure panel" can, but does not necessarily, include one or more of such enclosure panels.

DEFINITIONS

In describing and claiming the present invention, the following terminology will be used in accordance with the definitions set forth below.

As used herein, the term "lighting element pattern" is to be understood to refer to a pattern formed by a plurality of lighting elements, the pattern being defined by relative spacing of the lighting elements one from another. Generally, the pattern formed by the lighting elements will not be dependent upon an angle in which the pattern is viewed. In other words, two or more lighting elements that are spaced specific distances from one another define a lighting pattern, regardless of how the lighting elements may be collectively rotated, turned or moved in space (so long as the relative spacing between the lighting elements does not change). In order for two lighting element patterns to be distinct (or different) from another, the spacing between the lighting elements must be changed in some manner. Merely collectively rotating, turning or moving the lighting elements will not change the lighting element pattern.

As used herein, directionally relative terms such as upwardly, downwardly, laterally, etc., are sometimes used to refer to components of lighting systems and structural units or bases (e.g., houses, buildings, posts, overpasses, etc.) to which the lighting systems can be attached. It is to be understood that such terms are offered only to most clearly describe and claim the present invention and do not necessarily limit the scope of the invention.

As used herein, the term "substantially" refers to the complete or nearly complete extent or degree of an action, characteristic, property, state, structure, item, or result. For example, when two or more objects are referred to as being spaced a "substantially" constant distance from one another, it is understood that the two or more objects are spaced a completely unchanging distance from one another, or so nearly an unchanging distance from one another that a typical person would be unable to appreciate the difference. The exact allowable degree of deviation from absolute completeness may in some cases depend upon the specific context. However, generally speaking the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. For example, a cavity that is "substantially free of" foreign matter would either completely lack any foreign matter, or so nearly completely lack foreign matter that the effect would be the same as if it completely lacked foreign matter. In other words, a cavity that is "substantially free of" foreign matter may still actually contain minute portions of foreign matter so long as there is no measurable effect upon the cavity as a result thereof.

As used herein, the term "light-bearing" member can refer to a member that has lighting elements coupled to, attached to, or otherwise carried by the member along a length of the member. A light bearing member is typically retractable into, and extendable out of, a housing, and retraction and extension of the light-bearing member results in the lighting elements being moved relative to the housing. In some embodiments, a light-bearing member carries lighting elements along its length—that is, lighting elements are attached or coupled to the light-bearing member at positions distal from ends of the light-bearing element.

In some embodiments, light-bearing members are restrained to particular travel paths: e.g., all light-bearing members can be restrained to movement in a common plane, even though the light-bearing members extend downwardly from, and upwardly into, a housing.

In some embodiments, a "linking member" can function and appear the same as light-bearing members, except that the linking member may not carry lighting elements thereon. Linking members primarily provide structural support to light-bearing members in the same manner other light-bearing members provide support to one another.

When lighting elements or light-bearing members are discussed herein as being "retracted into a housing" or "extended from a housing," it is to be understood that the lighting element or light-bearing member need not be completely within all confines of the housing, or completely out of all confines of the housing, to qualify as "retracted" or "extended," respectively. For example, a majority of a light-bearing member may be disposed out of a housing and said light-bearing member could be considered extended from the housing, even though a portion of the light-bearing member may still reside within the confines of the housing. Similarly, most of a light-bearing member may be disposed within the confines of a housing (with a small portion remaining exposed beyond the confines of the housing) and the light-bearing member could still be considered "retracted" into the housing.

Also, light-bearing members are, at times, shown and discussed herein as being in a "display configuration." It is to be understood that a light-bearing member may be extended or retracted into a variety of positions that can all constitute a "display configuration." For example, a light-bearing member may have a maximum extension to which the member can be extended and maintained. However, the light-bearing member may have occupied a plethora of "display configurations" during extension of the light-bearing member (prior to reaching the maximum extension).

Furthermore, when a lighting element or light-bearing member (or other component of the systems described and shown herein) is discussed as being "retracted into" or "stored within" a housing, it is to be understood that the element or member being discussed may not be completely circumscribed by the housing to constitute being stored within the housing. For example, a housing may be shaped as a channel that is partially or fully open on one or more sides, yet an element or member may still be "stored" within the general confines of the housing. Thus, the housings of the present invention need not form complete enclosures but will generally serve to protect and conceal the components of the lighting system with two or more enclosure panels. In some embodiments, however, the housings of the present invention will be capable of completely enclosing the lighting system, for example by being provided with closeable doors or panels that can close after the components of the lighting system have been retracted into the housing.

As used herein, the term "about" is used to provide flexibility to a numerical range endpoint by providing that a given value may be "a little above" or "a little below" the endpoint.

Distances, angles, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 inch to about 5 inches" should be interpreted to include not only the explicitly recited values of about 1 inch to about 5 inches, but also include individual values and sub-ranges within the indicated range. This same principle applies to ranges reciting only one numerical value and should apply regardless of the breadth of the range or the characteristics being described.

THE INVENTION

The present invention is directed to lighting systems for providing informational or decorative lighting displays. In one aspect of the invention, systems in accordance with the present invention can be used to provide decorative or festive lighting to a home or residence. The invention can provide a decorative lighting system that can be substantially permanently installed on a home or dwelling and maintained in position throughout the year. Due to various advantages of the present invention, the operable components of the system can be protected and/or concealed within a housing, and selectively extended for use when desired. When a user no longer desires to display the lights, he or she can simply and easily retract the lights into the protective/concealing housing. The present invention thus provides a lighting system that can be used at selected times throughout the year, without requiring that a user hang, then uninstall, strings of light to create a lighting display.

As shown generally in FIGS. 1, 1A, 2 and 2A, in accordance with one embodiment of the invention, a lighting system 10 is provided that can be used for ornamental, decorative or informational lighting displays. The system can include a housing 12 that can be suitable for mounting to a structural unit (not shown), such as a dwelling, place of business, bridge or overpass, etc. The housing can include a plurality of enclosure panels 14*a*, 14*b*, 14*c*, 14*d* (note that frontal panel 14*a* is shown removed in FIGS. 1 and 1A; and that panel 14*d* is shown in an open configuration in FIG. 2 and in a closed configuration in FIG. 2A). The enclosure panels can collectively form the housing, which can, depending upon the embodiment, be configured as a fully enclosable housing, or a partially enclosable housing (e.g., the housing may only include 3 panels, with a lowermost section being substantially open to the surrounding environment).

At least one light-bearing member 16 can be moveable relative to each of the enclosure panels (e.g., the light-bearing member can move independently of any movement the enclosure panels may be capable of). An actuator 18 can be in operable communication with the at least one light-bearing member. The actuator can be operable to selectively: extend the light-bearing member from the housing into a display configuration (as shown by example in FIG. 1); and/or retract the light-bearing member into the housing (as shown by example in FIG. 2). In some embodiments, the actuator 18 need be capable only of retracting the light-bearing member into the housing: as gravity may be the only force required to extend the light-bearing members into the housing.

At least one lighting element 20 can be carried by the light-bearing member 16. The at least one lighting element can be visible by a spectator when the light-bearing member is at least partially extended from the housing 12. As will be appreciated by viewing FIGS. 1-2A, the actuators 18 can be suitable to selectively extend the light-bearing members from the confines of the housing so that a spectator can view the lighting elements. When desired, the actuators can retract the light bearing members into the housing (at which point control circuitry can discontinue power to the lighting elements to extinguish the lights), where the light-bearing members and the lighting elements can be protected from exposure to wind, water, snow, ice, etc., and/or can be concealed from view for aesthetic or architectural purposes.

The housing 12 shown can include enclosure panel 14*d* that can be moveable relative to housing, to open and close as needed to allow the light-bearing members 16 to extend from the housing. While not so required, in the embodiment shown the housing 12 includes a generally elongate configuration, with a width "W" of the housing being generally much greater than a height "H" or a depth "D" of the housing. In this aspect of the invention, the light-bearing members can include a length "L" that is greater than either the width depth "D" of the housing or the height "H" of the housing. In this manner, the light display provided by the system can occupy a much greater space than conventional systems and provide a much more pleasing array of lights.

Figure 2A:
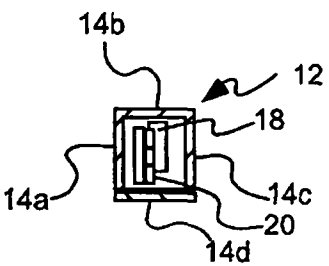
FIG. 2A is an end view of the system of FIG. 2 (with a lower enclosure panel 14*d* shown in a closed position)
Figure 1:
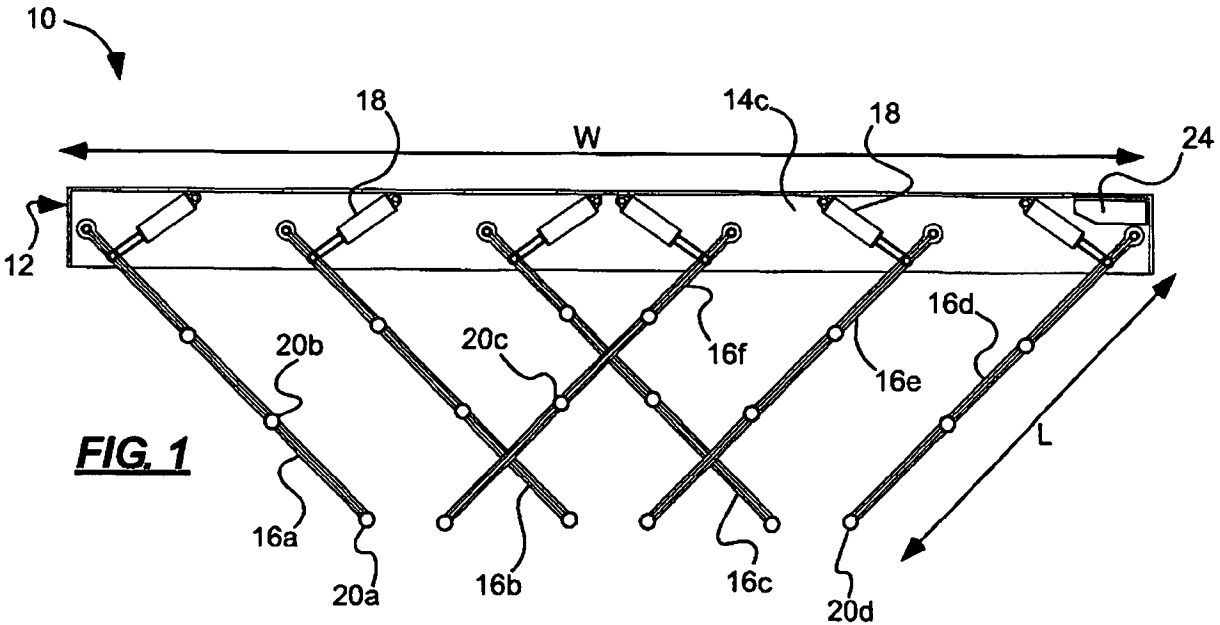
FIG. 1 is front view of a lighting system in accordance with an embodiment of the invention (with a frontal enclosure panel 14*a* shown removed from the housing)

In the embodiment illustrated in FIGS. 1-2A, the light-bearing members 16 are storable within the housing in a substantially parallel relationship to a longitudinal axis of the housing, and can be extendable into a display configuration so as to be oriented at a non-parallel angle to the longitudinal axis of the housing. In this manner, the storage space of the housing can be most efficiently utilized to provide good protection and/or concealment of the light-bearing members (and lighting elements 20) while providing a great deal of display spacing between individual lighting elements when the light-bearing members are extended from the housing.

In the embodiment shown in FIGS. 1-2A, the actuators 18 can include electrically activated solenoids, motors, or similar devices known to those having ordinary skill in the art, that can be individually or collectively activated by a control system (shown schematically at 24). For example, the control system may actuate the actuators associated with light-bearing members 16*a*-16*c* in a coordinated manner, causing each of these actuators to move at the same time and at the same rate. The actuators associated with light-bearing members 16*d-f* could similarly be coordinated. Thus, the control system can provide animation to the light display, creating a much more varied and visually pleasing presentation than is possible with conventional systems. Similarly, each of the solenoids or actuators can be individually actuated, resulting in an animated display that provides a user with a great deal of flexibility.

Figure 3A:
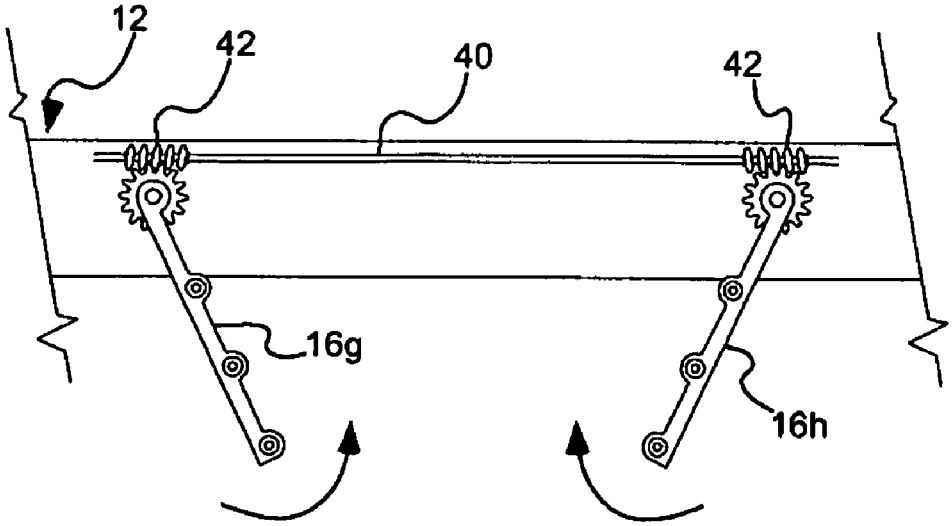
FIG. 3A is a front view of a portion of a light housing in accordance with an embodiment of the invention, with the light bearing members shown configured to rotate in opposite directions.
Figure 3B:
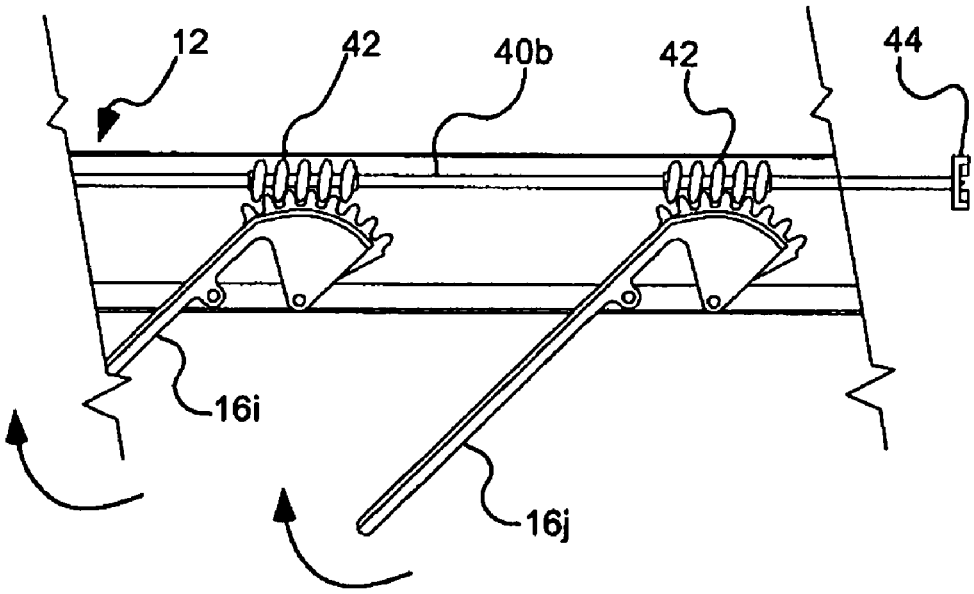
FIG. 3B is a front view of a portion of a light housing in accordance with an embodiment of the invention, with the light bearing members shown configured to rotate in the same direction.

In addition to the individual motors, actuators, solenoids, etc., shown in FIGS. 1-2A, the system can include one or more centralized motors or actuators that can be coupled to two or more of the light-bearing members. As shown in FIGS. 3A and 3B, in one aspect of the invention, a central shaft 40 can be provided that can be powered by an actuator (not shown in this view) to provide rotational movement to the shaft. A worm-gear assembly 42 can be associated with light-bearing members 16*g*, 16*h*. As the shaft 40 rotates, the worm gear assembly can cause the light-bearing members to move into or out of the housing. In the embodiment shown in FIG. 3A, rotation of the central shaft causes the light-bearing members to move at opposite rotational directions. In the embodiment illustrated in FIG. 3B, rotation of shaft 40*b* causes the light-bearing members 16*i*, 16*j* to move in the same rotational direction.

FIG. 3B also illustrates connector 44 that can be connected or associated with an actuator or motor to power the shaft 40*b*. One skilled in the relevant art, having possession of this disclosure, could readily understand the workings of such a system. The connector 44 can also be used to connect two or more of the housings 12 in series with one another, so that movement of one actuator can result in movement of each of a plurality of light-bearing members, even in the case where the light-bearing members are a part of system (e.g., are disposed within another housing) incorporated into an adjacent or distally located housing.

In addition to the solenoids, motors, etc., that can be used for the actuator, it is also contemplated that a manual actuator can be utilized. For example, the system can be readily adapted to utilize a hand crank or pull string/lever to retract and/or extend the light-bearing elements.

Figure 4A:
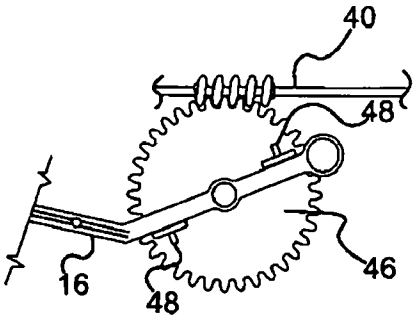
FIG. 4A is a partial view of a light system in accordance with an embodiment of the invention, with a gear rotated so as to allow a light-bearing member to swing freely.
Figure 4B:
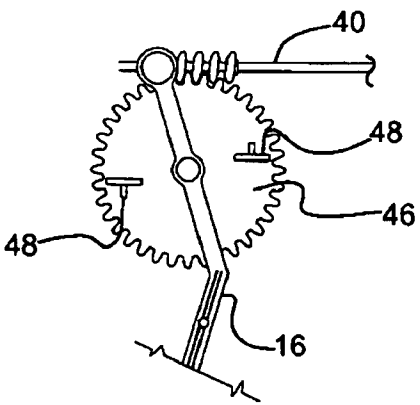
FIG. 4B is another view of the system of FIG. 4A, with the gear shown rotated so as to engage the light-bearing member.
Figure 6A:
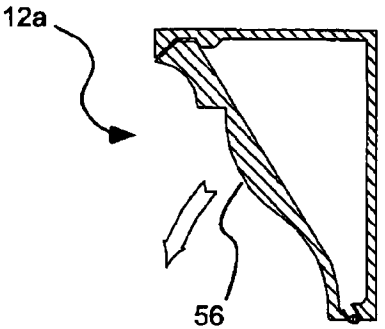
FIGS. 6A through 6D are a series of figures illustrating operation of a housing including a decorative panel in accordance with an embodiment of the invention.
Figure 6B:
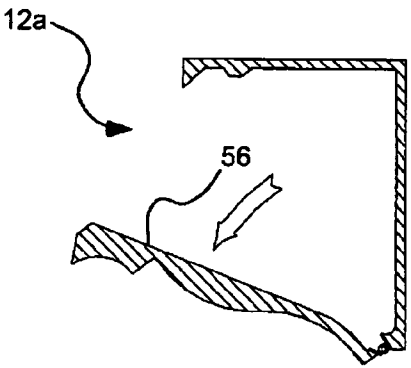
Figure 6C:
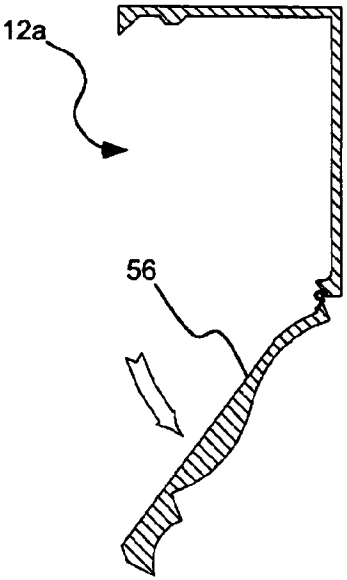
Figure 6D:
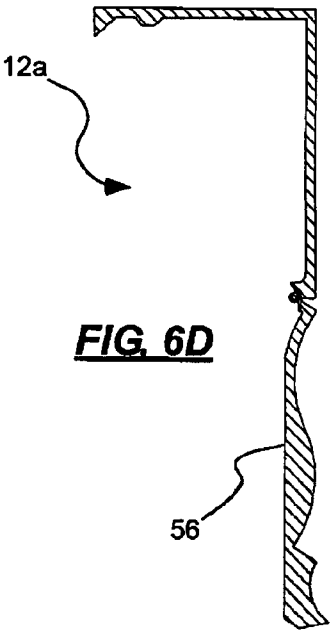

FIGS. 4A and 4B illustrate an aspect of the invention in which a light-bearing member is pivotally related to gear 46 that includes a pair of stops 48 that are positioned so as to engage the light-bearing member during only a portion of the rotational travel of the gear. This embodiment can be advantageous in applications in which it is desired, for one reason or another, to allow the light-bearing member to swing freely when in an extended, or display, configuration. As shown in FIG. 4A, when the gear is rotated to position the light-bearing member in a display orientation, the stops are spaced from the light-bearing member allowing the light-bearing member to swing freely in a limited amount of travel. When it is desired to retract the light-bearing member into the housing, gear 46 can rotate until stops 48 engage the light-bearing member and begin rotating it upwardly. This aspect of the invention has been found to perform well in applications in which the housing is installed at an angle from horizontal (e.g., along a slanted roofline), to allow the light-bearing members to swing freely downward in a substantially vertical display orientation, even when the housing is not level.

Figure 5:
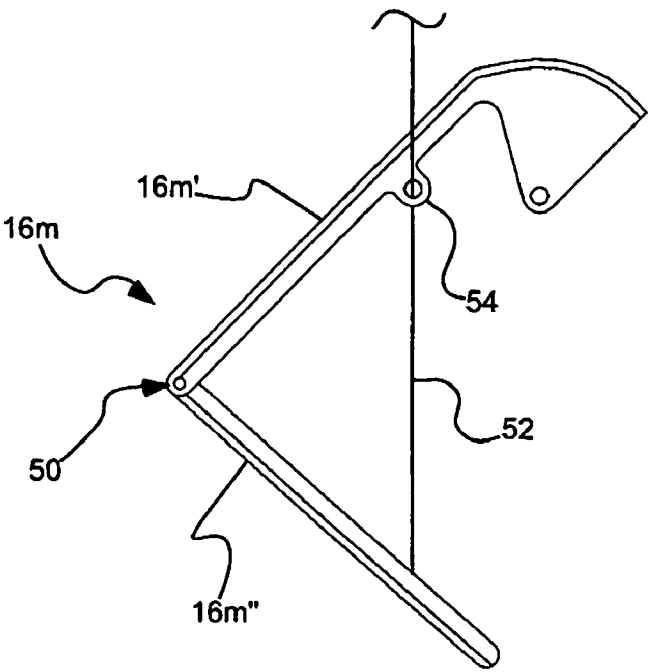
FIG. 5 is a front view of a segmented, articulated light-bearing member in accordance with an embodiment of the invention.

As shown in FIG. 5, in one aspect of the invention, a light-bearing member 16*m* can be provided that includes at least two substantially rigid segments 16*m*', 16*m*" that can be oriented in a non-parallel relationship to one another. While not so required, the segments can be moveably articulated at a joint 50 at which the segments are coupled to one another. In this manner, an overall display length of the light-bearing member can be leveraged while utilizing a relatively smaller storage space inside the housing (not shown in this view). In other words, the distance beyond which the light-bearing member can extend from the depth or height of the housing can be maintained while halving the storage distance required along the width of the housing.

One manner in which the light-bearing member can be retracted into the housing is by way of cord or tether 52 that can be incorporated into a spooling device (not shown) within the housing. The cord or tether can extend through an opening 54 in segment 16*m*' and can be coupled to segment 16*m*". As the cord is extended from the housing, segments 16*m*' and 16*m*" unfold from one another into an extended configuration. As the cord is retracted toward the housing, the segments fold into one another and are retracted into the housing.

In addition to including a segmented configuration, the light-bearing members of the present invention can include a decorative shape, to enhance the visual display of the system. Examples of decorative shapes include, without limitation, reindeer legs, skeleton legs, manikin arms or legs, candy canes, candles, stars, sled runners, etc. The decorative shapes of the light-bearing members can be particularly advantageous in systems that provide animation to the light-bearing members. In such systems, the "legs" or "arms" can be made to wave or dance to provide an active display unlike conventional displays. It is also contemplated that one or more of the light-bearing members may not bear lighting elements, but may instead be presented to add animation to a display. Thus, for example, in a Christmas display, one or more of the light-bearing members may be moved about and include lighting elements, while one or more may be moved about without contributing lighting affects, but only movement affects. Also, the light-bearing members may include the same decorative shape, or they can include differing decorative shapes.

One or more light-bearing members can include a plurality of sets of lighting elements that each include a different color, or form a different pattern, and can be selectively powered or controlled by the control system at differing times. As a non-limiting example, the light bearing member 16*n* shown in FIG. 8A can include lighting elements 20 that form a pattern of a snowman (as shown), and can also include other lighting elements (not shown) that form a pattern of a flag. The control system can be programmed or controlled such that, during Christmastime, for example, only the lighting elements that form the snowman are powered. During July $4^{th}$ celebrations, the lighting elements (not shown) that form the flag can be powered. It is has been found that, when not illuminated, the snowman-forming lighting elements will not be easily seen and will not interfere or detract from the flag pattern formed by the remaining lighting elements.

The control system 24 can be of a variety of types understood by those of ordinary skill in the art, and can be programmed or controlled locally or remotely. The control system can be in communication, for example, with a home computer to allow a user to program the system. The control system can include a remote control, to allow a user to remotely control the lighting patterns, light-bearing element motions, add musical effects, etc.

Figure 1A:
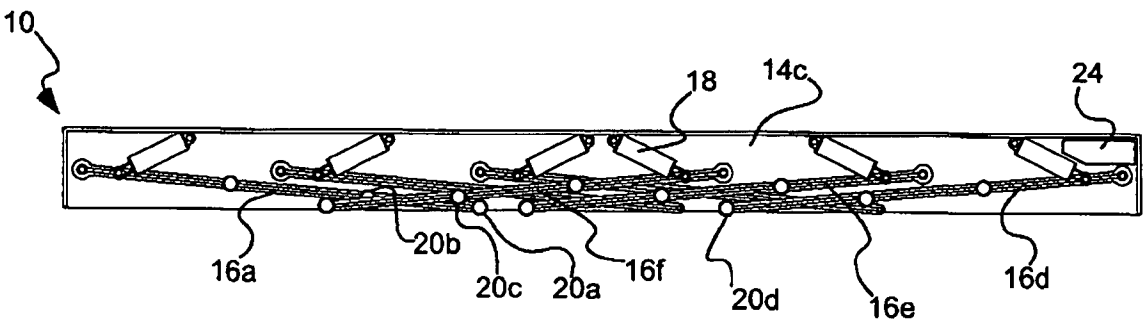
FIG. 1A is a front view of the system of FIG. 1, with a plurality of light-bearing members shown in a retracted condition.

Returning now to FIG. 1, in one aspect of the invention, a plurality of lighting elements 20*a*, 20*b*, 20*c*, 20*d*, etc., can be carried by a plurality of light-bearing members. In this embodiment, extension of the plurality of light-bearing members can result in changing relative spacing of at least some of the plurality of lighting elements from one another in both a vertical and a horizontal aspect. In other words, when the light-bearing members are in the storage or retracted configuration in the housing (as shown in FIG. 1A), the lighting elements are spaced from one another in a particular pattern. As the light-bearing members are extended from the housing (as shown in FIG. 1), the lighting elements assume a different spaced relationship from one another. While not so required, generally the lighting elements will be spaced further apart, both vertically and horizontally, from one another when in the extended position than when in the retracted (or stored) position. Thus, the present invention allows a more visually appealing, spatially disparate arrangement of lighting elements than conventional lighting systems, while also providing for storage or concealment of the lighting elements when desired.

FIGS. 6A through 6D illustrate an aspect of the invention in which a decorative panel 56 is attachable over or to (or formed integrally with) at least one of the enclosure panels to provide a decorative feature to the housing 12*a*. In this aspect of the invention, the decorative panel is formed to replicate exterior crown molding often applied to residential and commercial dwellings. The decorative feature can add to the unique manner in which the present invention can be integrated with an existing dwelling to conceal the decorative lighting assembly until it is desired to activate the lighting elements. When it is desired to active the lighting elements, the decorative housing panel 56 can be extended downward to allow light-bearing members (not shown in these figures) to be extended from the housing.

Figure 7A:
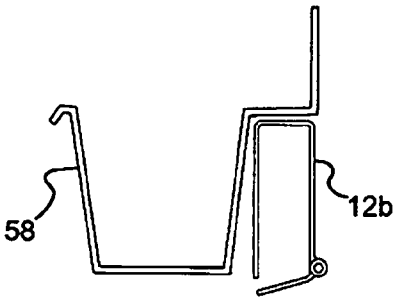
FIGS. 7A through 7C illustrate various housings incorporated with rain gutter systems in accordance with embodiments of the invention.
Figure 7B:
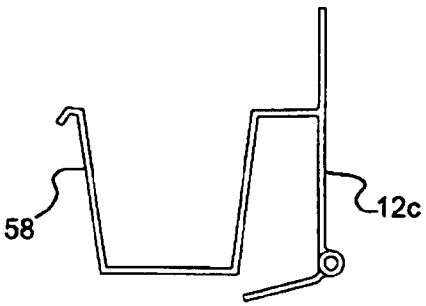
Figure 7C:
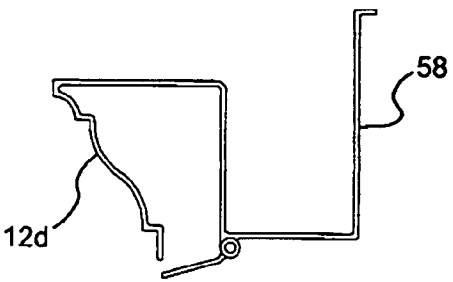

FIGS. 7A through 7C illustrate alternate housing configurations 12*b* through 12*d* that can be incorporated into various raingutter structure 58 to further integrate the present system within the ordinary appearance of the dwelling. It will be appreciated that the present system can be adapted into a variety of configurations to both allow safe storage of the lighting elements when the lighting system is not in use, and to conceal the appearance or presence of the lighting system when not in use.

Figure 8B:
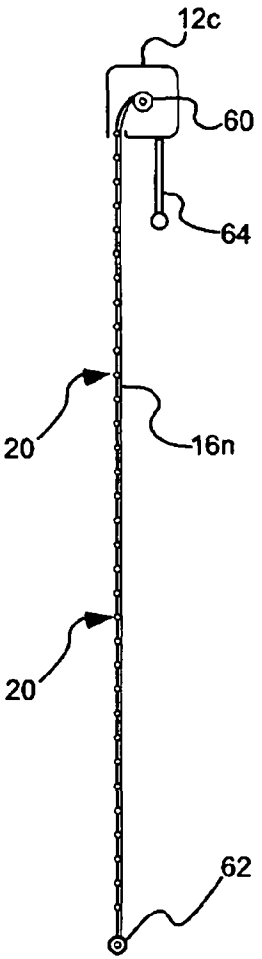
FIG. 8B is a side view of the system of FIG. 8A.
Figure 8A:
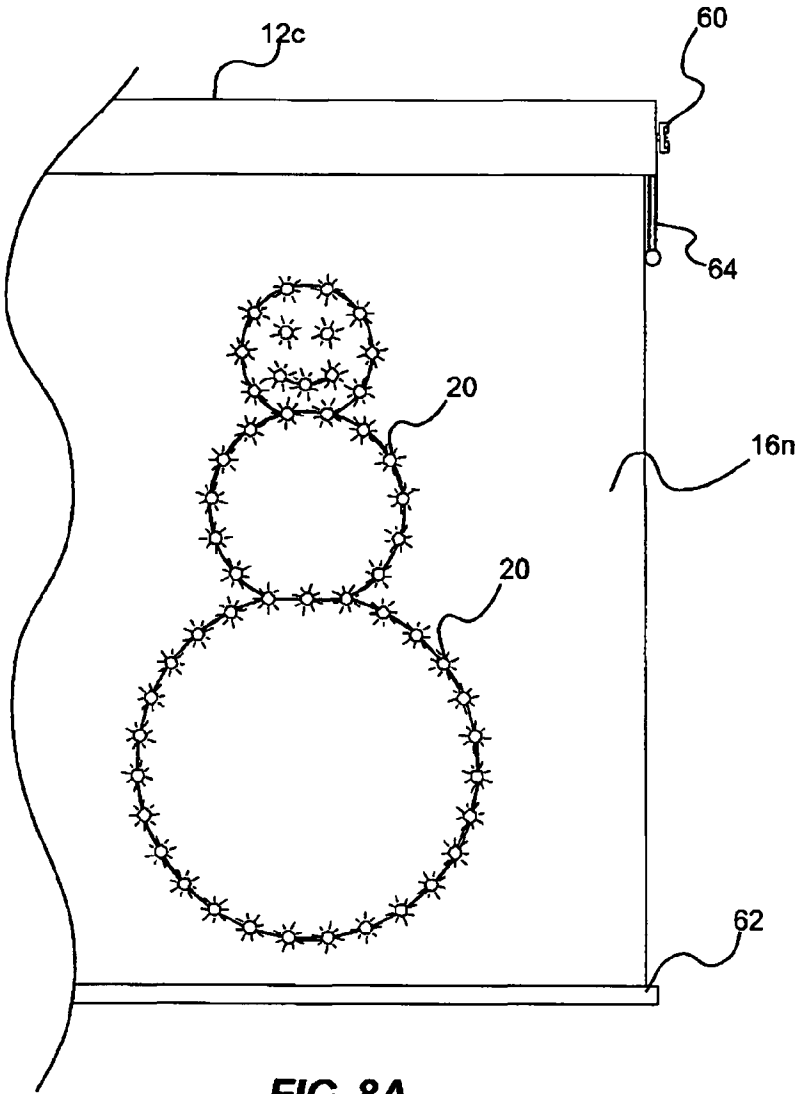
FIG. 8A is a partial, front view of another lighting system in accordance with an embodiment of the invention.

FIGS. 8A and 8B illustrate an embodiment of the invention in which the light-bearing member 16*n* includes a relatively flexible sheet onto which (or into or through which) lighting elements 20 can be incorporated. In this aspect of the invention, an actuator (not shown in detail) can be operably coupled to a roller 60 onto which the light-bearing can be rolled. When it is desired to extend the light-bearing member from the housing 12*e*, the actuator can unroll the light-bearing member and allow it to extend downwardly from the housing. A weight 62 can aid in unrolling the light-bearing member, and in maintaining the position of the light-bearing member once unrolled. The weight can be sized and shaped to serve as a "door" to the enclosure 12 to substantially seal the enclosure when the light-bearing member is rolled up.

FIGS. 8A and 8B also illustrate the use in the present system of one or more sensors 64 that can be advantageously used to automatically retract the light-bearing members of the present system in the case adverse weather conditions arise. For example, sensor 64 may be a wind speed sensor that can detect unsafe or undesirable wind conditions, and cause the control system to retract the light-bearing member or members into the housing. This aspect of the invention can aid in preventing damage being done to the system due to high or turbulent winds, heavy rain- or snow-fall, etc.

Figure 9A:
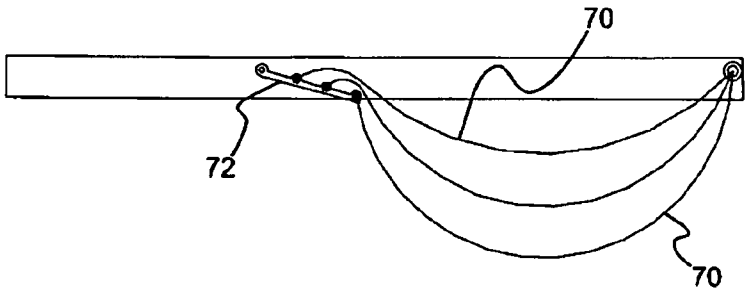
FIG. 9A is a front view of another lighting system in accordance with an embodiment of the invention.
Figure 9B:
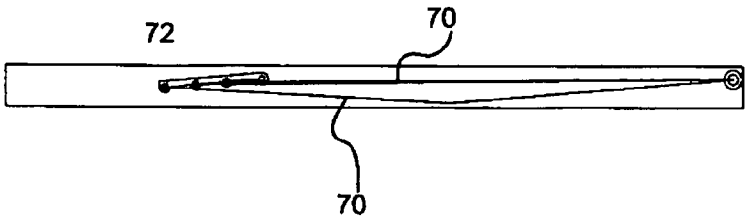
FIG. 9B is a front view of the system of FIG. 9A, shown in a retracted or closed configuration.
Figure 10A:
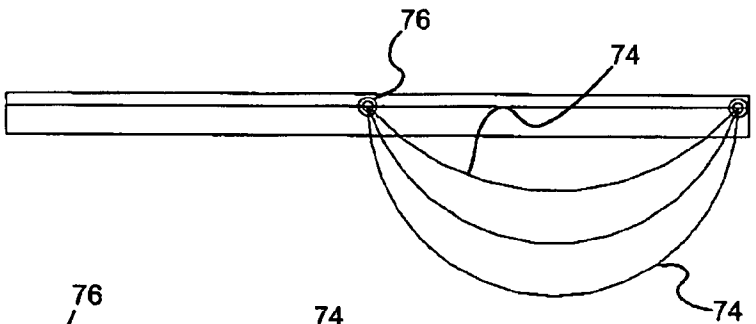
FIG. 10A is a front view of another lighting system in accordance with an embodiment of the invention.
Figure 10B:
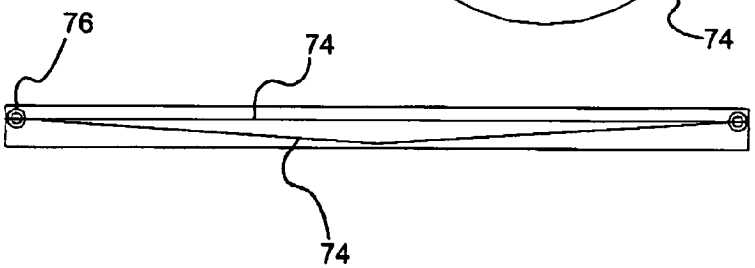
FIG. 10B is a front view of the system of FIG. 10A, shown in a retracted or closed configuration.

FIGS. 9A and 9B illustrate an embodiment of the invention in which the light-bearing member can include a series of flexible cords 70 on which lighting elements (not shown) can be attached (or with which lighting elements can be incorporated). This system includes a pivot arm 72 to which the light-bearing members are attached. As the arm pivots to the right of the figure, the light-bearing members "sag" or suspend downward to extend the lighting elements from the housing. As the pivot arm rotates to the left of the figure, the light-bearing member is stretched taught and retracts the lighting elements into the housing. FIGS. 10A and 10B illustrate a similar configuration, except that the light-bearing members 74 are coupled to a slider 76. As the slider moves left or right, the light-bearing members sag downward or become taught (depending upon the direction of travel of the slider).

Figure 11B:
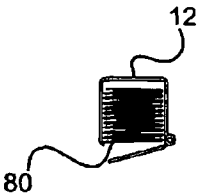
FIG. 11B is a side view of the system of FIG. 11A.
Figure 11A:
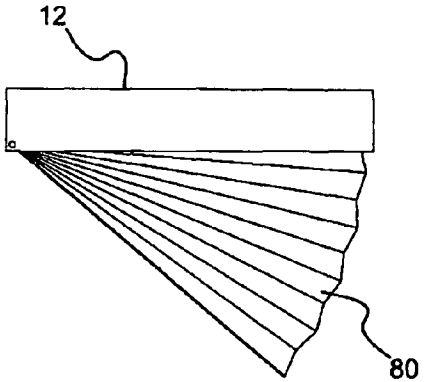
FIG. 11A is a front view of another lighting system in accordance with an embodiment of the invention, shown in a partially extended configuration.
Figure 11C:
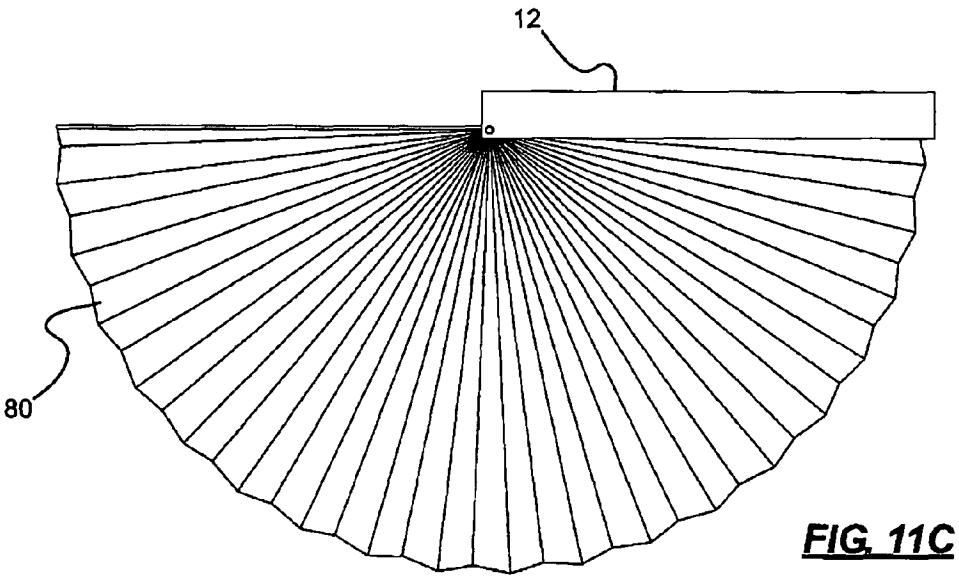
FIG. 11C is a front view of the system of FIG. 11A, shown in a substantially fully extended configuration.

FIGS. 11A through 11C illustrate another embodiment of the invention, with the light-bearing member 80 including, in this case, a foldable member that can retract into the housing by folding (in "accordion" style) into a compact, storable arrangement (as shown in FIG. 11B). FIG. 11C illustrates the light-bearing member in a substantially fully extended configuration. This embodiment of the invention can be particularly advantageous in applications where an odd-shaped space is being filled with a lighting display (e.g., a space between two angled rooflines, a half-circular window, etc.). Similar to the use of the weight 62 in the embodiment shown in FIGS. 8A and 8B, the lowermost portion of the light-bearing member 80 of FIGS. 11A-11C can be sized and shaped to serve as a bottom "door" of the enclosure 12 to substantially close or seal the enclosure when the light-bearing member is fully retracted into the housing. This aspect of the invention can be incorporated into a variety of different embodiments of the invention.

The present system can be powered in a number of manners (the control system 24 will likely require a power source). In one aspect of the invention, the power supply can be a conventional 120 volt connection. Other aspects of the invention can utilize a battery power source, solar power source, etc. Due to the many outdoor applications of the present invention, a solar power source has been found to be particularly efficacious.

The lighting elements 20 utilized with the present invention can take a variety of forms, including, without limitation, conventional incandescent bulbs, LED lights, fluorescent lights, etc. Due to the lightweight and flexible applications the present invention is suited for, the use of LED lights has been found to be particularly satisfactory.

Figure 12A:
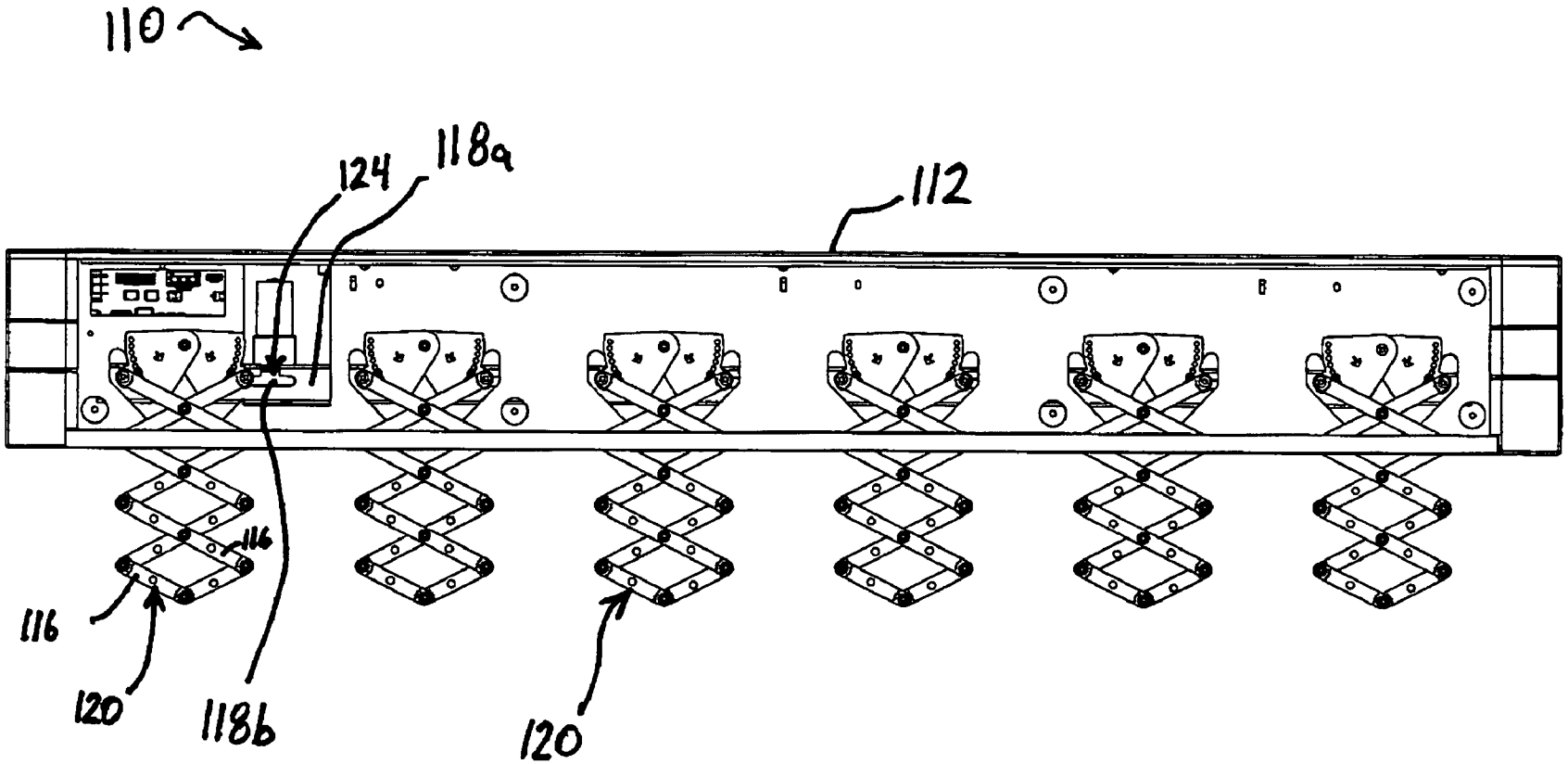
FIG. 12A is a front view of a lighting system in accordance with another aspect of the invention.
Figure 12B:
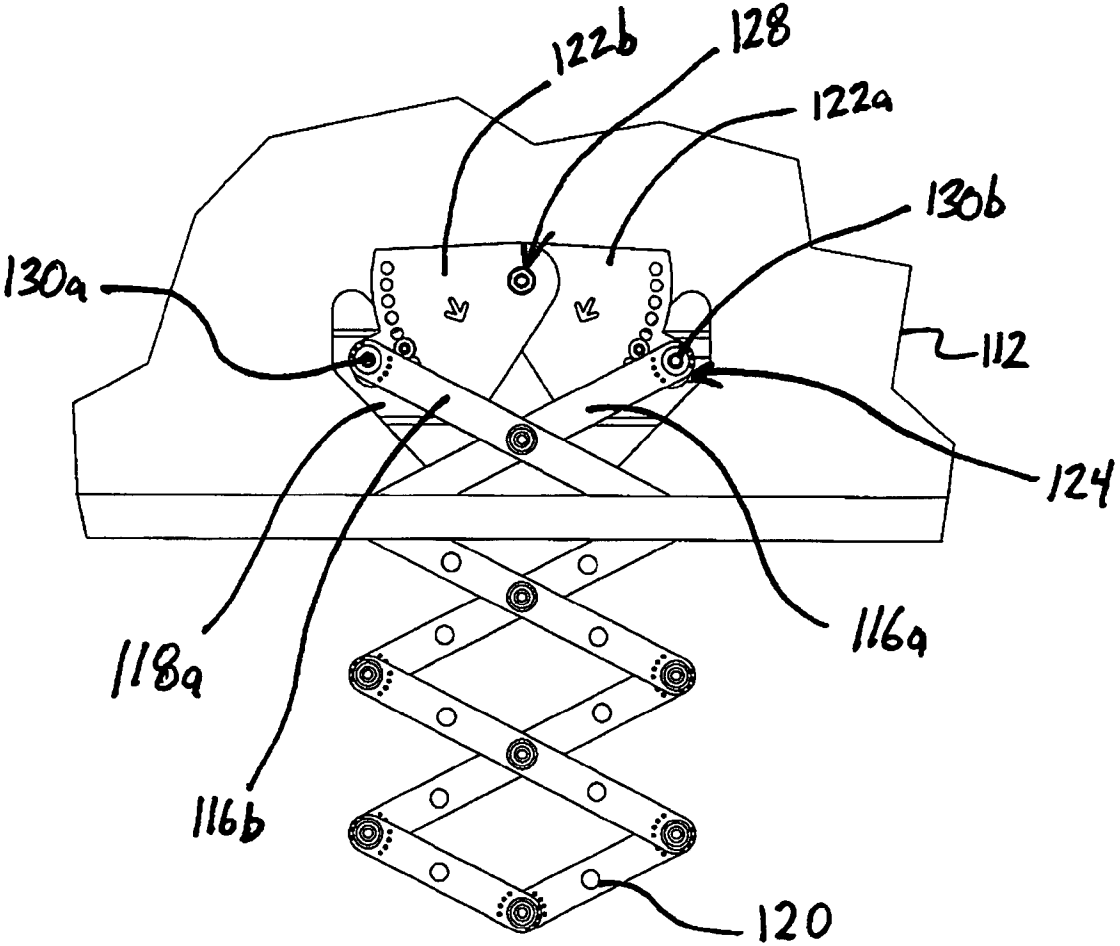
FIG. 12B is a more detailed view of a portion of the lighting system of FIG. 12A.
Figure 13:
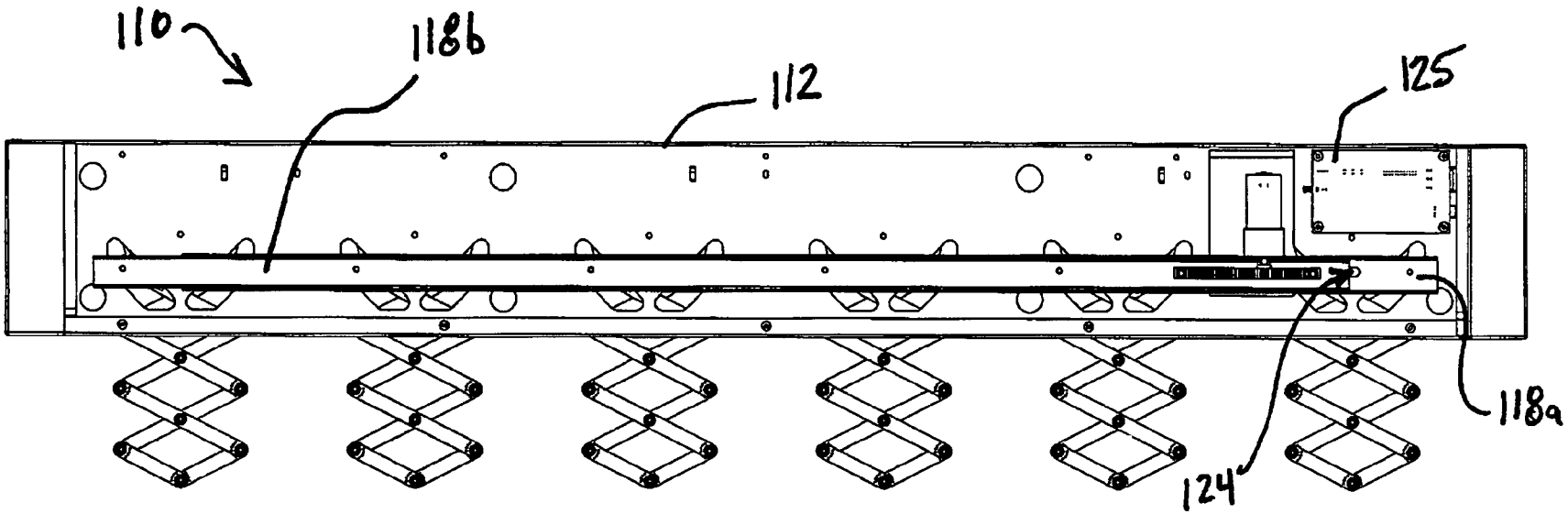
FIG. 13 is a rear view of the lighting system of FIG. 12A.
Figure 14A:
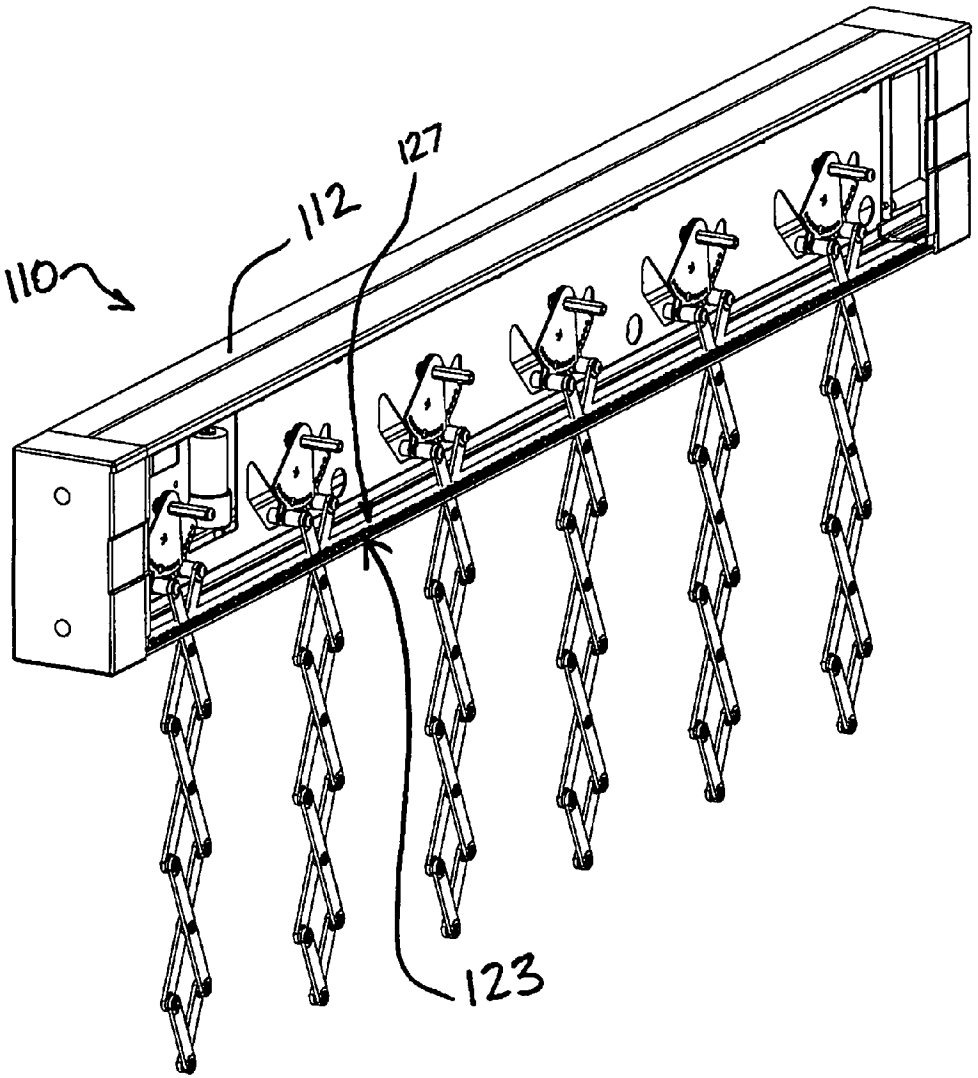
FIG. 14A is a perspective view of the lighting system of FIG. 12A, shown with the lighting elements extended from the housing.
Figure 14B:
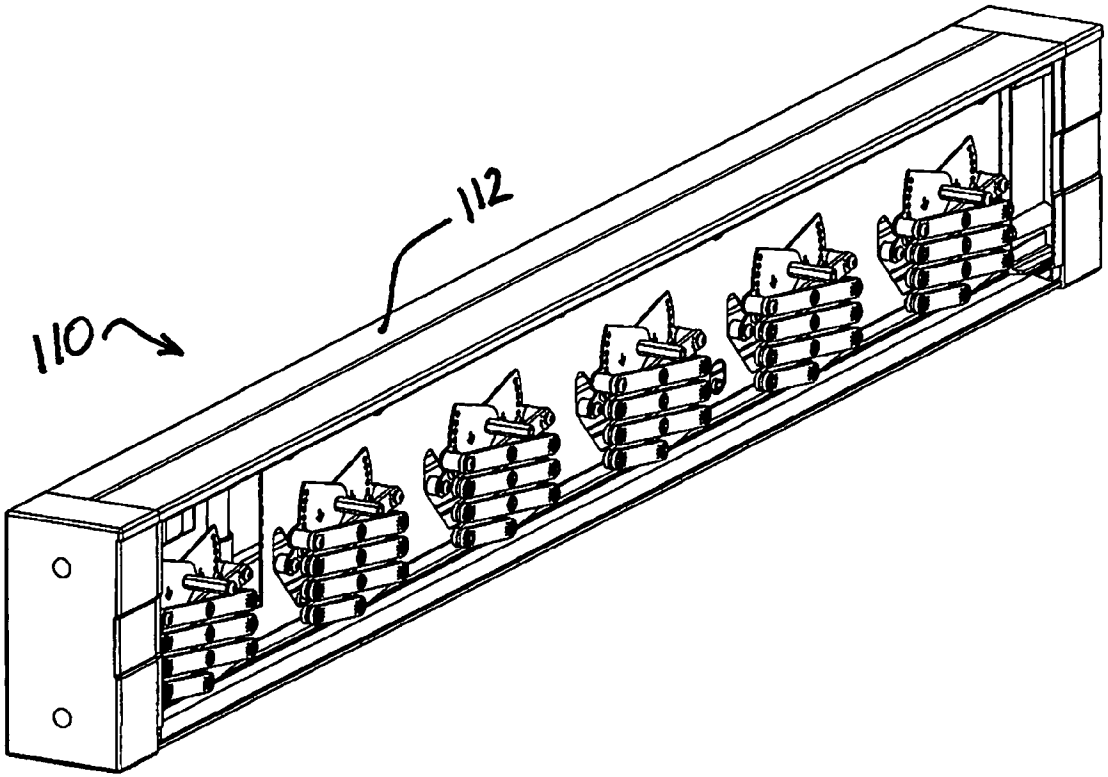
FIG. 14B is a perspective view of the lighting system of FIG. 12A, shown with the lighting elements retracted into the housing.

Turning now to FIGS. 12A through 14B, another embodiment of the invention is shown at 110. In this aspect of the invention, a series of light-bearing members 116 bear or carry various lighting elements 120. The light-bearing members can be extended from a housing 112 (an extended position is illustrated in FIG. 14A) and can be retracted into the housing when desired (as illustrated in FIG. 14B). In the example shown, the light-bearing members are coupled to a pair of actuators 118*a*, 118*b* (best appreciated from FIGS. 12A and 13).

As the actuators are moved relative to one another, the light-bearing members closest to the actuators (e.g., light-bearing members 116*a* and 116*b* in FIG. 12B) rotate, causing the linkage of light-bearing members to either retract into the housing or extend from the housing. As illustrated in FIG. 13, in one embodiment of the invention, the actuators 118*a* and 118*b* comprise a pair of elongate bars that are operable to slide linearly relative to one another. A series of slots 124 can be formed in one of the actuators (in actuator 118*a* in the embodiment shown), to allow a coupling post to extend from the rear actuator 118*b* and be coupled to the light-bearing member 116*a*. Thus, as the rear actuator 118*b* moves relative to the forward actuator 118*a*, the coupling post extending through the slot moves within the slot.

In this manner, each pair of light-bearing members 116*a* and 116*b* can coupled to the actuators 118*a* and 118*b* (respectively) such that linear relative movement of the actuators can result in the light-bearing members extending from or retracting into the housing 112. As will be appreciated from the figures, a plurality of light-bearing members 116 can be pivotally coupled to one another in a linked relationship. As the uppermost members 116*a* and 116*b* are moved by the actuators, the succession of light-bearing members moves in a parallel fashion. Due to the nesting configuration of the light-bearing members, however, the entire assembly can be easily extended far outside of the housing and substantially fully inside the housing, as is desired.

In the embodiment shown in the figures, a pair of cams 122*a* and 122*b* (best seen in FIG. 12B) can be coupled intermediate the light-bearing members 116 and the actuators 118*a*, 118*b*. The cams can include one or more connection points 126 that can enable attachment of the cams to the actuators and/or light-bearing members in a variety of locations. This system can advantageously allow the light-bearing members to be coupled to the actuators in a manner that varies an angle at which the light-bearing members extend from the housing.

For example, in the embodiment of the invention illustrated in FIGS. 12A, 12B and 13, the light bearing members form an array that extends substantially orthogonally from the housing. In this embodiment, the cams 122*a*, 122*b* are coupled to actuators 118*a*, 118*b* at equal distances from the pivot point 128 of the cams. However, by adjusting a location on the cams at which the actuators are coupled to the cams, an angle at which the array of light-bearing members extends from in the actuators (and thus the housing). For example, if it is assumed that the attachment point between the cams and the light-bearing members remains the same (e.g., point 130*a* and 130*b* in FIG. 12B), by changing a connection point at which the cams are coupled to the coupling the actuators, a change in angle of the light-bearing member array relative to the actuators can be accomplished.

This aspect of the invention can be advantageously utilized in a variety of settings. In one example, if the housing 112 is installed on or near the eave of a house that is angled relative to the ground, the connection points used to couple the cams to the actuators can be varied to allow the array of light-bearing members to extend vertically from the housing (e.g., orthogonally to a ground surface) without regard to the angle the eave forms relative to the ground.

The actuators 118*a*, 188*b* can take a variety of forms. In the embodiment shown, the actuators assume a nesting configuration, with the rear actuator 118*b* forming a channel within which the front actuator 118*a* rides. In this manner, a smooth, consistent motion can be achieved to enable multiple cycling of the light-bearing members into and out of the housing.

The actuators can be powered in a number of manners. In the example shown in FIG. 13, a worm-gear assembly is used to drive one or both of the actuators 118*a*, 118*b* laterally relative to each other to achieve the movement desired to cause extension or retraction of the light-bearing members. A control system 125 can be installed within the housing to enable control of the various movement and lighting capabilities of the system. One of ordinary skill in the art, having possession of this disclosure, could readily adapt known control systems to effectuate the inventive concepts of the present invention.

As shown in FIG. 14A, in one aspect of the invention, one of the enclosure panels (the lowermost panel shown in the figure) can include a slot or port 127 through which the light-bearing members can extend. The port can be sized so as to allow the enclosure panel to protect the various internal components of the housing, while still leaving room for the light-bearing members (and the lights they bear) to be extended from and retracted into the housing. In one aspect of the invention, a flexible barrier 123 can be integrated with, or attached adjacent, the port 127. In the example shown, the flexible barrier includes a series of bristles that provide a sufficient barrier to entry of debris into the housing, but allow the light-bearing members to be extended through and retracted into the port. The flexible barrier can take a variety of forms, including a flexible wiper strip and the like.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A lighting system, comprising:

a housing, suitable for mounting to a structural unit, the housing including a plurality of enclosure panels;

at least two light-bearing members, moveable relative to the housing and pivotally coupled one to another;

a pair of actuators, moveable in opposing directions, one of the light-bearing members being coupled to one of the actuators and an other of the light-bearing members being coupled to an other of the actuators; wherein movement of the actuators relative to one another results in pivotal movement of the light-bearing members relative to one another, causing an end of each light-bearing member to move further from or closer to the housing; and wherein the at least two light-bearing members form an array that decreases in width as the members extend from the enclosure and increases in width as they are retracted into the enclosure.

2. The system of claim 1, further comprising a plurality of pairs of light-bearing members, ends of each pair of light-bearing members being pivotally coupled to ends of at least one other pair of light-bearing members in a linked relationship.

3. The system of claim 1, wherein the at least two light-bearing members are pivotally coupled to one another at midpoints of the light-bearing members, such that the light-bearing members rotate symmetrically about the coupled midpoints.

4. The system of claim 1, further comprising a pair of cams, and wherein each light-bearing member is coupled to a cam and each cam is coupled to one of the actuators.

5. The system of claim 4, wherein each cam includes an array of connection points, the array of connection points providing variably angled connectivity between one of the cam and the actuator.

6. The system of claim 5, wherein the array of connection points comprises a series of coupling ports formed in the cams.

7. The system of claim 5, wherein the cams are pivotally coupled one to another.

8. The system of claim 5, wherein each cam is removably couplable at the connection points to enable adjustment of an angle between the cam and the actuator.

9. The system of claim 1, further comprising an extension port, formed in or through one of the enclosure panels, the extension port allowing the light-bearing members to extend from the enclosure through a portion of the enclosure otherwise covered by the enclosure panel.

10. A lighting system, comprising:

a housing, suitable for mounting to a structural unit, the housing including a plurality of enclosure panels;

at least two linear actuators, moveable relative to one another;

at least two light-bearing members, retractable into and extendable from the housing; and a pair of cams, each cam couplable to one of the actuators and to one of the light-bearing members; and each cam having a plurality of connection points associated therewith, with one of: a linear actuator and a light-bearing member, being removably coupled at the connection points;

wherein movement of the actuators relative to one another results in movement of the cams and movement of the light-bearing members, causing the light-bearing members to be extended from or retracted into the housing; wherein the at least two light-bearing members are pivotally coupled to one another at midpoints of the light-bearing members, such that the light-bearing members rotate symmetrically about the coupled midpoints.

11. The system of claim 10, further comprising a plurality of pairs of light-bearing members, ends of each pair of light-bearing members being pivotally coupled to ends of at least one other pair of light-bearing members in a linked relationship.

12. The system of claim 10, wherein the plurality of connection points comprises a series of coupling ports formed in the cams.

13. The system of claim 12, wherein the cams are pivotally coupled one to another.

14. The system of claim 10, further comprising an extension port, formed in or through one of the enclosure panels, the extension port allowing the light-bearing members to extend from the enclosure through a portion of the enclosure otherwise covered by the enclosure panel.

15. The system of claim 10, wherein the at least two light-bearing members form an array that decreases in width as the members extend from the enclosure and increases in width as they are retracted into the enclosure.

16. The system of claim 10, further comprising a plurality of pairs of light-bearing members, ends of each pair of light-bearing members being pivotally coupled to ends of at least one other pair of light-bearing members in a linked relationship.

17. The system of claim 16, wherein the plurality of light-bearing members are substantially completely retractable into the housing.

18. The system of claim 10, wherein the at least two linear actuators slide adjacent one another in opposing directions.

19. A lighting system, comprising:

a housing, suitable for mounting to a structural unit, the housing including a plurality of enclosure panels;

at least two light-bearing members, moveable relative to the housing and pivotally coupled one to another;

a pair of actuators, moveable in opposing directions, one of the light-bearing members being coupled to one of the actuators and an other of the light-bearing members being coupled to an other of the actuators; wherein movement of the actuators relative to one another results in pivotal movement of the light-bearing members relative to one another, causing an end of each light-bearing member to move further from or closer to the housing; and further comprising a plurality of pairs of light-bearing members, ends of each pair of light-bearing members being pivotally coupled to ends of at least one other pair of light-bearing members in a linked relationship.

* * * * *